US006679390B1

(12) United States Patent
Wallen

(10) Patent No.: US 6,679,390 B1
(45) Date of Patent: Jan. 20, 2004

(54) STORAGE ADAPTER FOR RATCHET WRENCH

(76) Inventor: Ron Wallen, 105 N. 64th Dr., Phoenix, AZ (US) 85043

( * ) Notice: Subject to any disclaimer, the term of this patent is extended or adjusted under 35 U.S.C. 154(b) by 95 days.

(21) Appl. No.: 10/041,105

(22) Filed: Jan. 7, 2002

(51) Int. Cl.[7] ..... A47F 7/00
(52) U.S. Cl. ..... 211/70.6; 206/378
(58) Field of Search ..... 211/70.6; 206/378, 206/376

(56) References Cited

U.S. PATENT DOCUMENTS 5,154,544 A * 10/1992 Arendt ..... 206/378 X
5,573,116 A * 11/1996 Zink ..... 206/378
5,897,001 A * 4/1999 Dembicks ..... 211/70.6
5,975,297 A * 11/1999 Kao ..... 206/378
6,044,985 A * 4/2000 Kao ..... 211/70.6
6,095,329 A * 8/2000 Kao ..... 206/378
6,431,373 B1 * 8/2002 Blick ..... 211/70.6
6,450,338 B1 * 9/2002 Chen ..... 206/378
6,494,329 B1 * 12/2002 Dembicks ..... 211/70.6

* cited by examiner

*Primary Examiner*—Robert W. Gibson, Jr.
(74) *Attorney, Agent, or Firm*—Ellis & Venable, P.C.

(57) ABSTRACT

A ratchet wrench storage adapter for use with a prior art storage mechanism for sockets. The ratchet wrench storage adapter comprises a ratchet wrench coupling opening bounded by a wrench receiving opening edge that is further coupled to an storage adapter clip. The adapter can then be coupled to the ratchet wrench and also to a prior art storage mechanism.

12 Claims, 3 Drawing Sheets

STORAGE ADAPTER FOR RATCHET WRENCH

BACKGROUND OF THE INVENTION

1. Field of the Invention

The invention is applicable in the field of tools and particularly so in the field of structures for securely storing ratchet wrenches together with a set of sockets.

2. Discussion of the Related Art

Ratchet wrenches and sockets are old in the art. A ratchet wrench 10 and a set of sockets 11 are illustrated in FIG. 1*a*. Sets of sockets 11 are sometimes but not always sold with an organizational storage unit. Thus, it is common for sockets 11 and ratchets wrenches 10 to be separated and lost. After market solutions have partially remedied the above problem. FIG. 2*a* illustrates a ratchet wrench 10 and a prior art method only for storing sockets 11.

SUMMARY OF THE INVENTION

Aspects of the invention are summarized below to aid in the understanding of embodiment(s) of the invention and the application. Yet, the invention is fully. defined by the claims of the application.

The invention is a ratchet wrench storage adapter for use with a prior art mechanism for storing a set of sockets 11. The ratchet wrench storage adapter comprises a ratchet wrench coupling opening 261, also referred to herein as a ratchet wrench coupling aperture 261 and a socket coupling protrusion aperture 261 (see FIG. 2*c*), bounded by a wrench receiving opening edge that is further coupled to a storage adapter clip.

An aspect of an embodiment the invention is a structure to conveniently couple a ratchet wrench 10 to a prior art structure for storing sockets 11.

An aspect of an embodiment the invention is a construction to conveniently couple a ratchet wrench 10 to a prior art structure for storing sockets 11.

An aspect of an embodiment the invention is a construction that enables a ratchet wrench 10 to be removably coupled to a prior art structure for storing sockets 11.

An aspect of an embodiment of the invention is to construct the invention is to construct the adapter using a socket 11 and an socket clip 14.

An aspect of the invention is to size the adapter for alternate size ratchet wrenches 10, sockets 11, storage rails 16 and socket clips 14.

DESCRIPTION OF AN EMBODIMENT

Figure 1A:
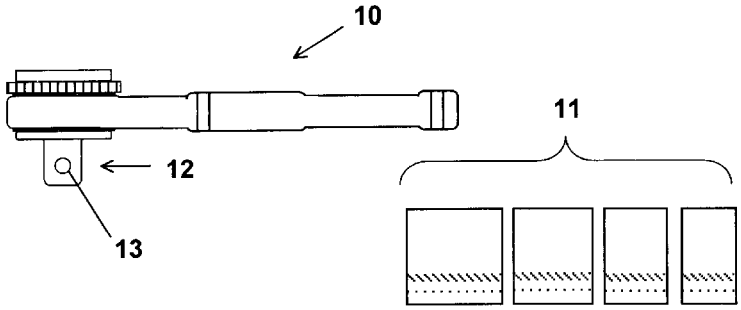
FIG. 1*a* illustrates an exemplary ratchet wrench 10 and set of sockets 11.
Figure 1B:
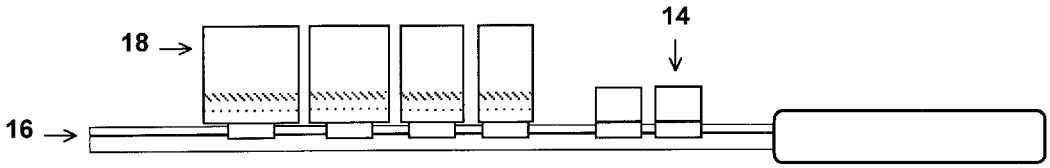
Fig. 1b Prior Art
FIG. 1*b* illustrates a set of sockets 18 coupled to a prior art socket 11 storage mechanism comprising a rail 16 and socket clips 14 coupled thereto.

An exemplary prior art ratchet wrench 10 is illustrated in FIG. 1*a* and has a socket coupling protrusion 12 adapted to receive each of the sockets 11. The socket coupling protrusion 12 further includes a semi-recessed spring-biased ball 13 that engages a dimple in the inside wall of the sockets 11 to hold the socket 11 to the socket coupling protrusion 12.

A prior art socket storage mechanism comprises a rail 16 with socket clips 14. The socket clips 14 have a protruding portion with dimensions that are similar to the socket coupling protrusion 12 to engage and secure a socket 11. The socket clips 14 further have a clip portion that is pressure-fit to the rail 16. A rail 16 and set of socket clips 14 together form a convenient means of storing sockets 11.

Figure 2A:
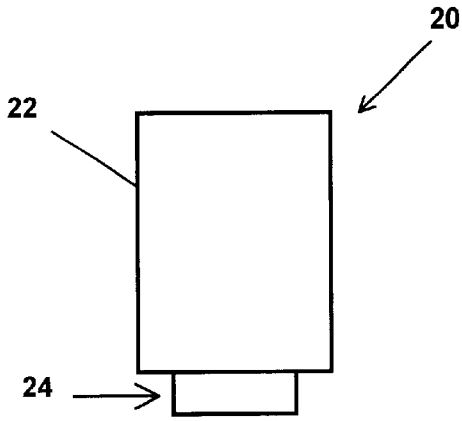
FIG. 2*a* illustrates a first side view of the embodiment of the ratchet storage adapter 20.
Figure 2B:
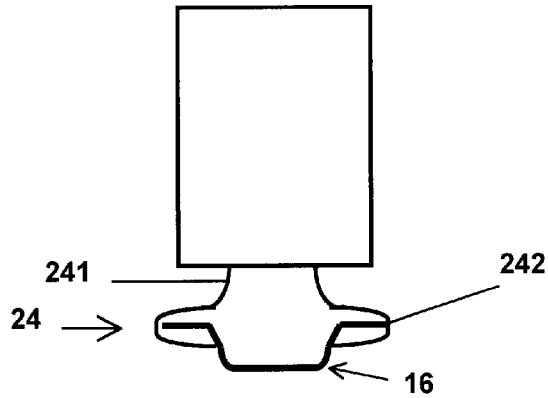
FIG. 2*b* illustrates a second side view, 180 degrees displaced from the first side view in FIG. 3*a*, of the embodiment of the ratchet storage adapter 20.
Figure 2C:
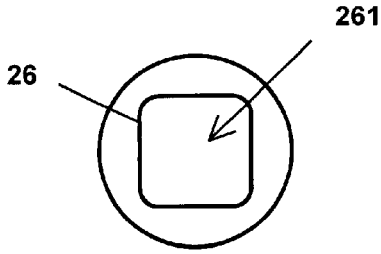
FIG. 2*c* illustrates a top view of the embodiment of the ratchet storage adapter 20.
Figure 2D:
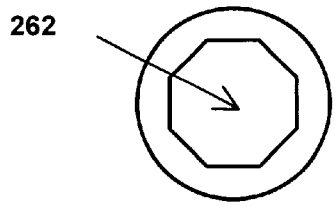
FIG. 2*d* illustrates a bottom view of the embodiment of the ratchet storage adapter 20.

A preferred embodiment ratchet storage adapter 20 implementing the invention is illustrated in detail in FIGS. 2*a*–2*c*. The ratchet storage adapter 20 comprises a ratchet adapter body portion 22 having a wrench coupling opening bounded by a wrench receiving opening edge 26. In a preferred embodiment, the ratchet adapter body portion 22 is substantially cylindrically shaped and the receiving opening edge 26 extends laterally and in a substantially parallel manner through the ratchet adapter body portion 22. The wrench receiving opening edge 26 is sized to receive the socket coupling protrusion 12 in close contact. In a preferred embodiment, the edge 26 perimeter is square as shown in FIG. 2*c*.

Figure 3A:
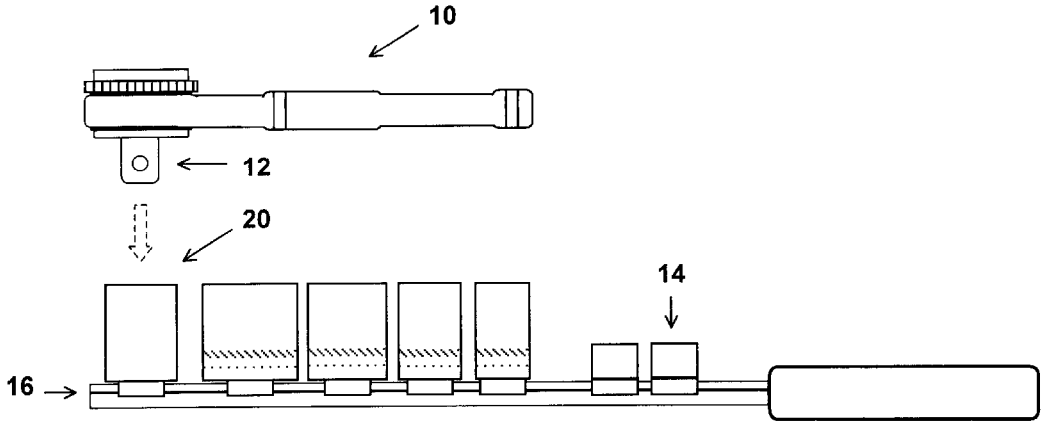
FIG. 3*a* illustrates an embodiment of the ratchet storage adapter 20 coupled to the rail 16 of the prior art socket storage mechanism.
Figure 3B:
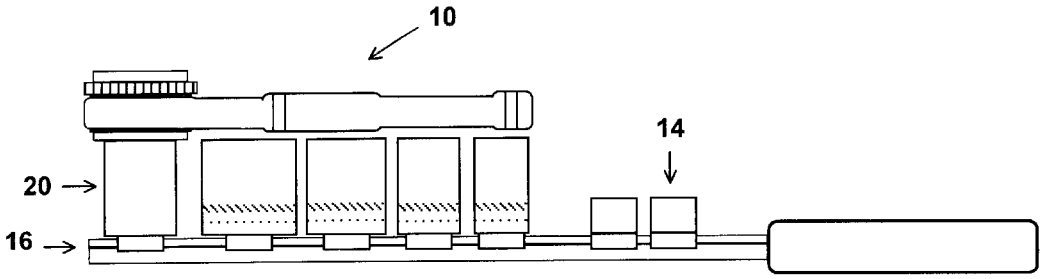
FIG. 3*b* illustrates the embodiment of the ratchet wrench 10 coupled to the ratchet storage adapter 20.

A preferred ratchet adapter body portion 22 is further coupled to a clip that is sized to engage the rail 16 by pressure fit. The clip is a mechanical structure that connects to the rail 16 by any means ordinary in the art. The preferred clip is illustrated in the figures as a clip 24 and has a first portion 241 that extends laterally and in a substantially parallel manner from the ratchet adapter portion 22, and a second portion 242 that extends in a curved manner from the first portion to contact, at least partially, the rail 16 by an enclosing pressure fit as depicted in FIG. 2*b*. A Finally, the preferred ratchet adapter body portion 22 is inline with the socket coupling protrusion 12 so that the body of the ratchet wrench 10 is able to lay in line with the rail 16 when the ratchet wrench 10 is coupled to the ratchet storage adapter 20. See FIG. 3*b*. The ratchet wrench 10 is coupled to the ratchet storage adapter 20 by inserting the socket coupling protrusion 12 into the wrench receiving opening edge 26.

An exemplary construction of the ratchet storage adapter 20 is fashioned from an ordinary socket 11. For the purposes of construction, an exemplary socket 11 will comprise a first bolt engaging aperture 262 having an bolt aperture edge and a second wrench engaging aperture having a wrench aperture edge for receiving the coupling protrusion 12. The ratchet storage adapter 20 is constructed by securing, such as by bonding (e.g. weld, glue, molding, etc.), a socket clip 14 to the first bolt engaging aperture of the exemplary socket 11. Moreover, while the exemplary construction is preferably metal, additional construction materials are also contemplated to be effective materials for constructing embodiments of the invention.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A ratchet wrench storage adapter for coupling a ratchet wrench having a socket coupling protrusion, to a socket storing mechanism that comprises a rail and socket coupling clips that couple to the rail, the ratchet wrench storage adapter comprising: a body portion coupled to the rail and the body portion further having a ratchet wrench coupling aperture bounded by a ratchet wrench coupling aperture edge that is adapted to receive the socket coupling protrusion of the ratchet wrench.

2. The ratchet wrench storage adapter in claim 1, wherein, the body portion is coupled to the rail with a clip that engages the rail with a pressure fit.

3. The ratchet wrench storage adapter in claim 1 wherein, the wrench receiving opening edge is substantially perpendicular to the rail.

4. The ratchet wrench storage adapter in claim 1 wherein, the wrench receiving opening edge extends in a substantially parallel manner through the body portion.

5. The ratchet wrench storage adapter in claim 1 wherein, the body portion is removably coupled to the rail.

6. The ratchet wrench storage adapter in claim 5 wherein, the body portion is removably coupled to the rail by a storage adapter clip comprising: at least a first portion that extends in a substantially lateral and parallel manner from the body portion, and a second portion that extends in a curved manner from the first portion to contact, at least partially, the rail by an enclosing pressure fit.

7. A ratchet wrench storage adapter for a socket set storing mechanism, the socket set storing mechanism comprising a rail and socket clips, the wrench storage adapter comprising; a body portion coupled to the rail by at least a one clip that has a first portion extending from the body portion and second portion that contacts the rail in at least semi-enclosing contact, the body portion further having a wrench coupling opening bounded by a wrench receiving opening edge.

8. The ratchet wrench storage adapter in claim 7 wherein, the wrench receiving opening edge is substantially perpendicular to the rail.

9. The ratchet wrench storage adapter in claim 7 wherein, the wrench receiving opening edge extends in a substantially parallel manner through the body portion.

10. A ratchet wrench storage adapter construction comprising; a socket having a bolt engaging aperture, and a socket coupling protrusion engaging aperture having an aperture edge for receiving a socket coupling protrusion of a ratchet wrench, the socket secured to a clip.

11. The ratchet wrench storage adapter construction in claim 10 wherein, the socket is secured to a clip by bonding the clip into the bolt engaging aperture.

12. The wrench storage construction in claim 10 wherein, the clip comprises at least a first portion that extends from the socket at a direction substantially parallel from the bolt aperture edge and at least a second portion that curves substantially perpendicularly to the first portion.

* * * * *